US012589901B2

(12) United States Patent
Brake et al.

(10) Patent No.: US 12,589,901 B2
(45) Date of Patent: Mar. 31, 2026

(54) CORNER POST APPLICATION SYSTEM

(71) Applicant: Mollers North America, Inc., Grand Rapids, MI (US)

(72) Inventors: Jason A. Brake, Kent City, MI (US); Jeremy N. Hockenberry, Kentwood, MI (US); David C. Johnson, North Muskegon, MI (US); Peter C. Martin, Hudsonville, MI (US); Robert A. Van Ocker, Greenville, MI (US); Jonathan Van Sweden, Grand Rapids, MI (US)

(73) Assignee: Mollers North America, Inc., Grand Rapids, MI (US)

( * ) Notice: Subject to any disclaimer, the term of this patent is extended or adjusted under 35 U.S.C. 154(b) by 33 days.

(21) Appl. No.: 18/460,073

(22) Filed: Sep. 1, 2023

(65) Prior Publication Data

US 2024/0076078 A1 Mar. 7, 2024

Related U.S. Application Data

(60) Provisional application No. 63/403,345, filed on Sep. 2, 2022.

(51) Int. Cl.
*B65B 13/18* (2006.01)
*B65B 11/02* (2006.01)
(Continued)

(52) U.S. Cl.
CPC ..... *B65B 13/181* (2013.01); *B65B 11/025* (2013.01); *B65B 59/001* (2019.05); *B65B 59/02* (2013.01)

(58) Field of Classification Search
CPC ... B65B 13/181; B65B 59/001; B65B 11/025; B65B 59/02
See application file for complete search history.

(56) References Cited

U.S. PATENT DOCUMENTS 3,378,987 A 4/1968 Lems
3,585,780 A 6/1971 Elmore
(Continued)

FOREIGN PATENT DOCUMENTS

CA 2747134 A1 3/2003
CN 114572445 A * 6/2022 ..... B05C 1/02
(Continued)

OTHER PUBLICATIONS

Mollers North America, Inc. brochure on PLS Split-Plate Palletizing System showing system that was in existence prior to 2010.
(Continued)

*Primary Examiner* — Lucas E. A. Palmer
(74) *Attorney, Agent, or Firm* — Gardner, Linn, Burkhart & Ondersma LLP

(57) ABSTRACT

A corner post application system for a load having corners includes corner post applicators and moveable corner post holders. The corner post applicators include a corner post gripper configured to grasp a corner post, with the corner post applicators configured to move the corner post to a corner of the load. The corner post holders each have a clamp and are moveable between a retracted position and an engaged position, where in the engaged position the clamp is configured to engage a respective corner post to press the corner post against the load at the respective corner. When the corner post holders are in the engaged position the corner post applicators are configured to be retracted with the corner posts being held in engagement with the corners of the load by the corner post holders to enable an enveloping machine to initiate placement of a film over the load.

13 Claims, 12 Drawing Sheets

(51) Int. Cl.
*B65B 59/00* (2006.01)
*B65B 59/02* (2006.01)

(56) References Cited

U.S. PATENT DOCUMENTS

| | | | | |
|---|---|---|---|---|
| 3,902,303 | A | 9/1975 | King | |
| 4,799,818 | A | 1/1989 | Sudimak et al. | |
| 4,897,980 | A | 2/1990 | Geyser et al. | |
| 5,226,280 | A * | 7/1993 | Scherer | B65B 13/181 221/211 |
| 5,423,118 | A * | 6/1995 | Lotti | B65B 13/181 29/809 |
| 5,535,572 | A * | 7/1996 | Morantz | B65B 11/025 53/139.7 |
| 5,544,472 | A | 8/1996 | Koskinen et al. | |
| 5,546,730 | A | 8/1996 | Newell et al. | |
| 5,564,254 | A * | 10/1996 | Thimon | B65B 13/181 53/410 |
| 5,596,863 | A | 1/1997 | Kasel | |
| 5,758,470 | A | 6/1998 | Lancaster, III | |
| 5,868,549 | A | 2/1999 | Lee et al. | |
| 5,881,653 | A | 3/1999 | Pfister | |
| 6,012,266 | A | 1/2000 | Koskinen et al. | |
| 6,178,721 | B1 | 1/2001 | Turfan | |
| 6,508,044 | B2 * | 1/2003 | Suolahti | B65B 13/181 414/797 |
| 6,651,859 | B2 * | 11/2003 | Raffoni | B25B 5/142 227/100 |
| 6,883,293 | B2 | 4/2005 | Lancaster, III et al. | |
| 6,990,784 | B2 | 1/2006 | Lancaster, III et al. | |
| 7,213,381 | B2 | 5/2007 | Zitella et al. | |
| 7,234,289 | B2 | 6/2007 | Hannen et al. | |
| 7,320,172 | B1 | 1/2008 | Kamiya | |
| 7,320,403 | B2 | 1/2008 | May, Jr. | |
| 7,325,371 | B2 | 2/2008 | Cere' | |
| 7,748,198 | B2 | 7/2010 | Cere' | |
| 8,938,934 | B2 | 1/2015 | Brunson et al. | |
| 9,394,069 | B2 | 7/2016 | Smith et al. | |
| 9,802,723 | B2 | 10/2017 | Brunson et al. | |
| 2003/0051439 | A1 * | 3/2003 | Lancaster, III | B65B 11/025 53/399 |
| 2004/0261360 | A1 * | 12/2004 | Cere | B65B 13/181 53/410 |
| 2005/0137072 | A1 * | 6/2005 | Jackson | B31B 50/00 493/171 |
| 2006/0168911 | A1 * | 8/2006 | Owen | B65B 51/05 53/411 |
| 2012/0055123 | A1 * | 3/2012 | Brunson | B65B 9/135 53/558 |
| 2025/0178763 | A1 * | 6/2025 | Martin | B65B 51/14 |

FOREIGN PATENT DOCUMENTS

| | | |
|---|---|---|
| EP | 0798214 B1 | 10/1997 |
| EP | 1419966 A1 | 5/2004 |

OTHER PUBLICATIONS

Mollers North America, Inc. brochure on Robotic Palletizing System showing system that was in existence prior to 2010.
Mollers North America, Inc. brochure on HSA Automatic Stretch-Hooding Systems showing system that was in existence prior to 2010.
International Search Report completed Feb. 29, 2012 from International Application No. PCT/US2011/049416.
Written Opinion of the International Searching Authority for International Application No. PCT/US2011/049416.
Extended European Search Report completed Feb. 4, 2014, from European Application No. EP 11 82 0748.
Mollers North America, Inc. brochure on PFS Floor-Level Modular Palletizing System showing system that was in existence prior to 2010.

* cited by examiner

PRIOR ART

PRIOR ART

CORNER POST APPLICATION SYSTEM

CROSS REFERENCE TO RELATED APPLICATION

The present application claims priority of U.S. provisional application, Ser. No. 63/403,345 filed Sep. 2, 2022, which is hereby incorporated herein by reference in its entirety.

BACKGROUND AND FIELD OF THE INVENTION

The present invention is directed to an improved system and method for automatically positioning corner posts or boards on loads, and more particularly to a system and method for automatically positioning corner posts or boards on loads that are in the process of undergoing any of a stretch-wrapping, binding, stretch-hooding, or other similar enveloping type processes.

In the past, the automatic placement of corner posts on loads—such as palletized loads of boxes, cartons, or the like—has been accomplished during stretch wrapping operations. In such systems, an applicator mechanism positions corner posts on the four corners of the load and holds them in position until the stretch wrapping operation has secured the corner posts to the load. The applicator mechanism then retracts and the wrapped load is moved via one or more conveyors. A new unwrapped load may then be moved into position for wrapping and corner posts may be placed on the load in the same manner.

SUMMARY OF THE INVENTION

The present invention provides systems and methods for automatically placing corner posts on loads during an enveloping process—such as, but not limited to, a stretch hooding, stretch wrapping, binding, or other similar process—that are efficient, economical, and able to operate within the space limitations of the enveloping machine. The system includes corner board holders that cooperatively operate with corner board applicators and the enveloping process to retain corner boards in place while a load is being enveloped, and in particular are configured to retain corner boards in place that are shorter in length, such as may be used on loads that are of limited or shorter height. The application of the corner boards thus enables protection of the products making up the shorter loads while still maintaining a desired corner post application time.

According to an aspect of the present invention, a corner post application system for a load containing a plurality of units defining corners of the load comprises a plurality of corner post applicators and a plurality of moveable corner post holders. The corner post applicators each have a corner post gripper configured to grasp a corner post, with the corner post applicators being configured to move a respective corner post to a load and engage the corner post with a respective corner of the load. The corner post holders each have a clamp and are moveable between a retracted position and an engaged position, where in the engaged position the clamp is configured to engage a respective one of the corner posts to press the corner post against the load at the respective corner. When the corner post holders are in the engaged position the corner post applicators are configured to be retracted with the corner posts being held in engagement with the corners of the load by the corner post holders to enable an enveloping machine to initiate placement of a film over the load.

In accordance with a particular embodiment, the corner post holders comprise a drive unit, such as a cylinder, and a clamp arm with the clamp mounted to the clamp arm, and with the drive unit being operable to move the corner post holder between the retracted and engaged positions. The clamp arm may comprise a pivot arm configured to pivot about a pivot axis between the retracted and engaged positions. Still further, the pivot axis may comprise a vertical axis, and the pivot arm may comprise an upwardly extending portion to which the clamp is mounted with the drive unit being positioned vertically lower than the clamp. The clamps are configured to engage the corner posts at a vertically lower position than where the corner post applicators are configured to grasp the corner posts.

According to a still further aspect of the present invention, a corner post application system for a load containing a plurality of units defining corners of the load comprises a load support, an enveloping machine adapted to envelope the load with a film when the load is disposed on the load support, a plurality of corner post containers for storage of corner posts, a plurality of corner post applicators, and a plurality of moveable corner post holders. The corner post applicators each have a corner post gripper configured to grasp a corner post from a selected corner post container, with the corner post applicators being configured to move a respective corner post to a load and engage the corner post with a respective corner of the load. The corner post holders each have a clamp and are moveable between a retracted position and an engaged position, where in the engaged position the clamp is configured to engage a respective one of the corner posts to press the corner post against the load at the respective corner. When the corner post holders are in the engaged position the corner post applicators are configured to be retracted with the corner posts being held in engagement with the corners of the load by the corner post holders to enable an enveloping machine to initiate placement of a film over the load.

In a particular embodiment the enveloping machine is a stretch hooding machine and includes a stretch hooding carriage configured to apply the film to the load starting from the top of the load, with the corner post applicators configured to be retracted with the corner posts being held in engagement with the corners of the load by the corner post holders when the stretch hooding carriage applies the film to the top of the load and top portions of the corner posts.

According to yet another aspect of the present invention, a method of applying corner posts to corners of a load containing a plurality of units defining corners of the load comprises grasping corner posts with corner post applicators, moving the corner posts with the corner post applicators to a load, and placing the corner posts against respective corners of the load using the corner post applicators. The method further includes, moving corner post holders from a retracted position to an engaged position, where each corner post holder has a clamp and where in the engaged position each clamp is configured to engage a respective corner post to press the corner post against the load at the respective corner. The method includes initiating application of a film by an enveloping machine to a top of the load and a top portion of the corner posts, retracting the corner post applicators from the corner posts, continuing downward application of the film to the load by the enveloping machine, moving the corner post holders to the retracted position such that the clamps are disengaged from the respective corner posts, retaining the corner posts against the load with the film, and finishing enveloping of the load with the enveloping machine, with clamps being disengaged from the respective corner posts prior to finishing enveloping of the load with the enveloping machine.

These and other objects, advantages, purposes and features of this invention will become apparent upon review of the following specification in conjunction with the drawings.

DESCRIPTION OF THE PREFERRED EMBODIMENTS

The present invention will now be described with reference to the accompanying figures, wherein the numbered elements in the following written description correspond to like-numbered elements in the figures.

FIGS. 1-4 illustrate a prior art corner post application system 20 according to an embodiment of U.S. Pat. Nos. 8,938,934 and 9,802,723, which patents are commonly owned by Möllers North America, Inc. of Grand Rapids, Michigan, and are incorporated herein by reference in their entireties. As understood from FIG. 1, corner post application system 20 includes an enveloping machine 22, which may be a stretch wrapping machine, a stretch hooding machine, a binding machine, or any other type of machine that is adapted to envelope a load 42 with a binding material. Corner post application system 20 is adapted to automatically place corner posts 40 on the load 42 prior to its being bound with material. Once bound, the corner posts 40 are held in place by the material and help bring stability and strength to the bundled plurality of individual units that make up the load 42.

Figure 1:
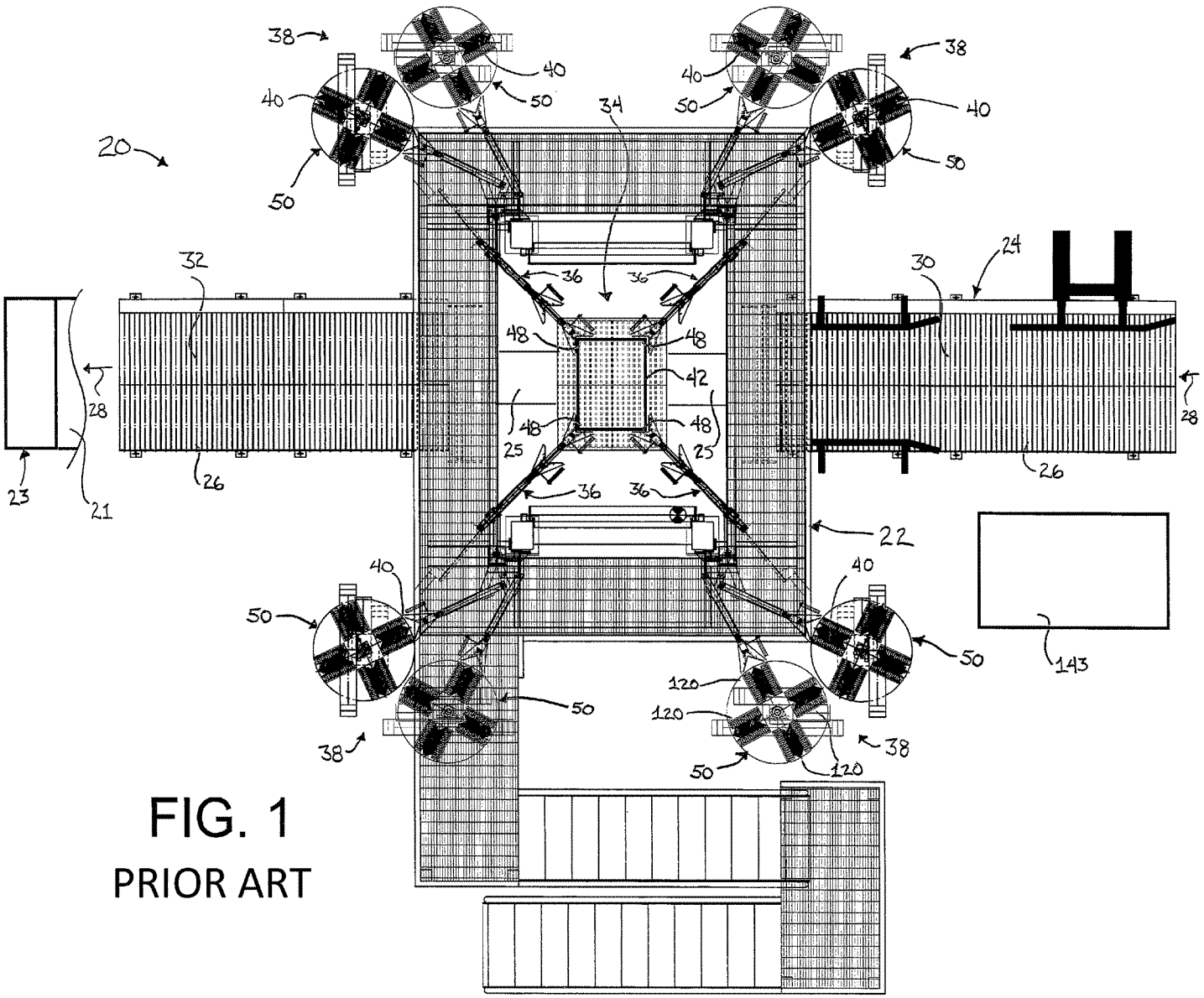
FIG. 1 PRIOR ART
FIG. 1 is a plan view of a prior art embodiment of a corner post application system that includes a stretch hooding machine and four corner post applicators.

In the embodiment depicted in FIG. 1, enveloping machine 22 is a stretch hooding machine that receives plastic hooding material 21 from film dispenser or applicator 23. While the various figures included herein all depict enveloping machine 22 as a stretch hooding machine, it will be understood by those skilled in the art that the principles disclosed herein are not limited to stretch hooding machines, but may be applied to any type of enveloping machine.

Figure 2:
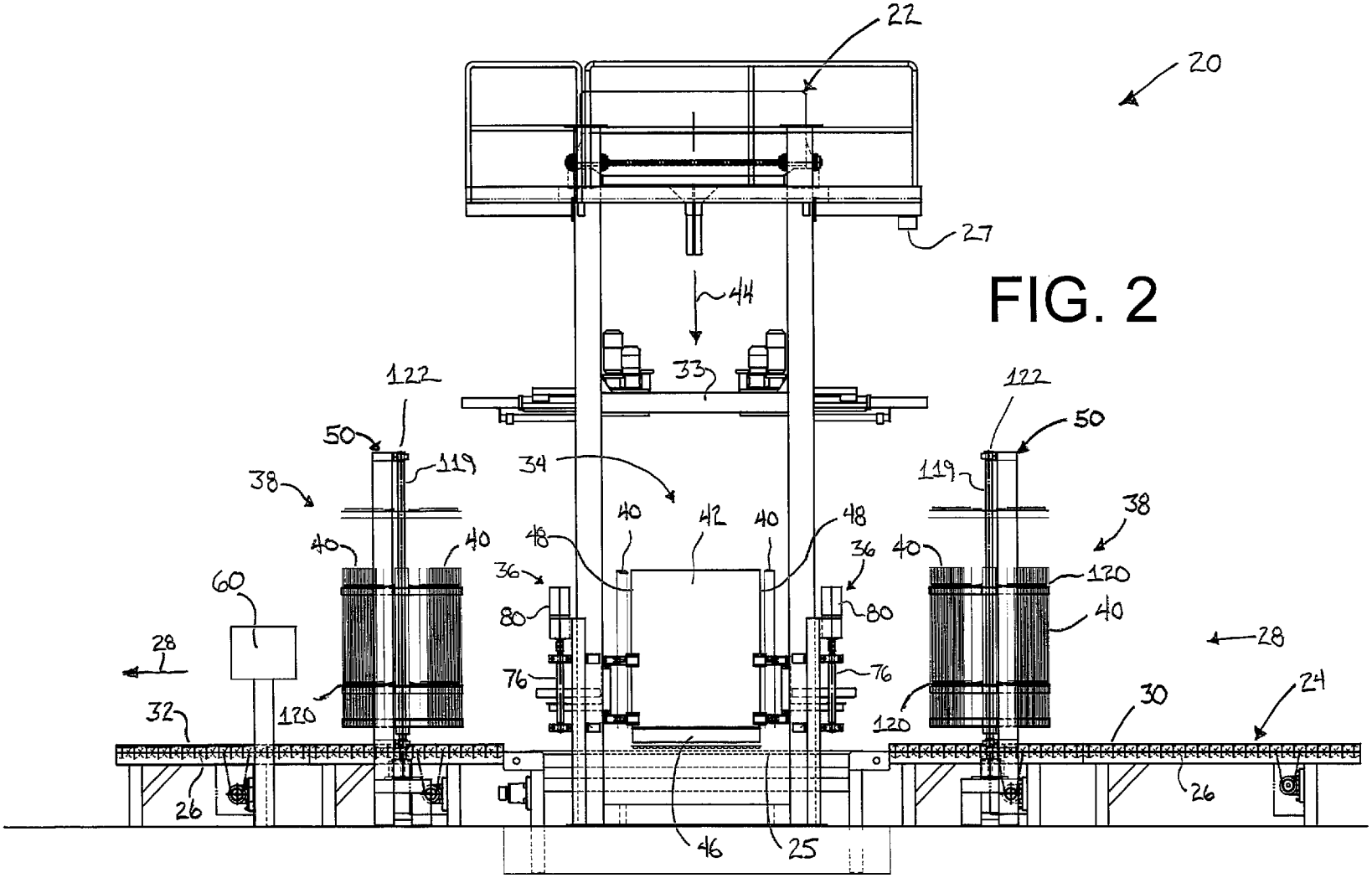
FIG. 2 is a side elevation view of the system of FIG. 1.
Figure 3:
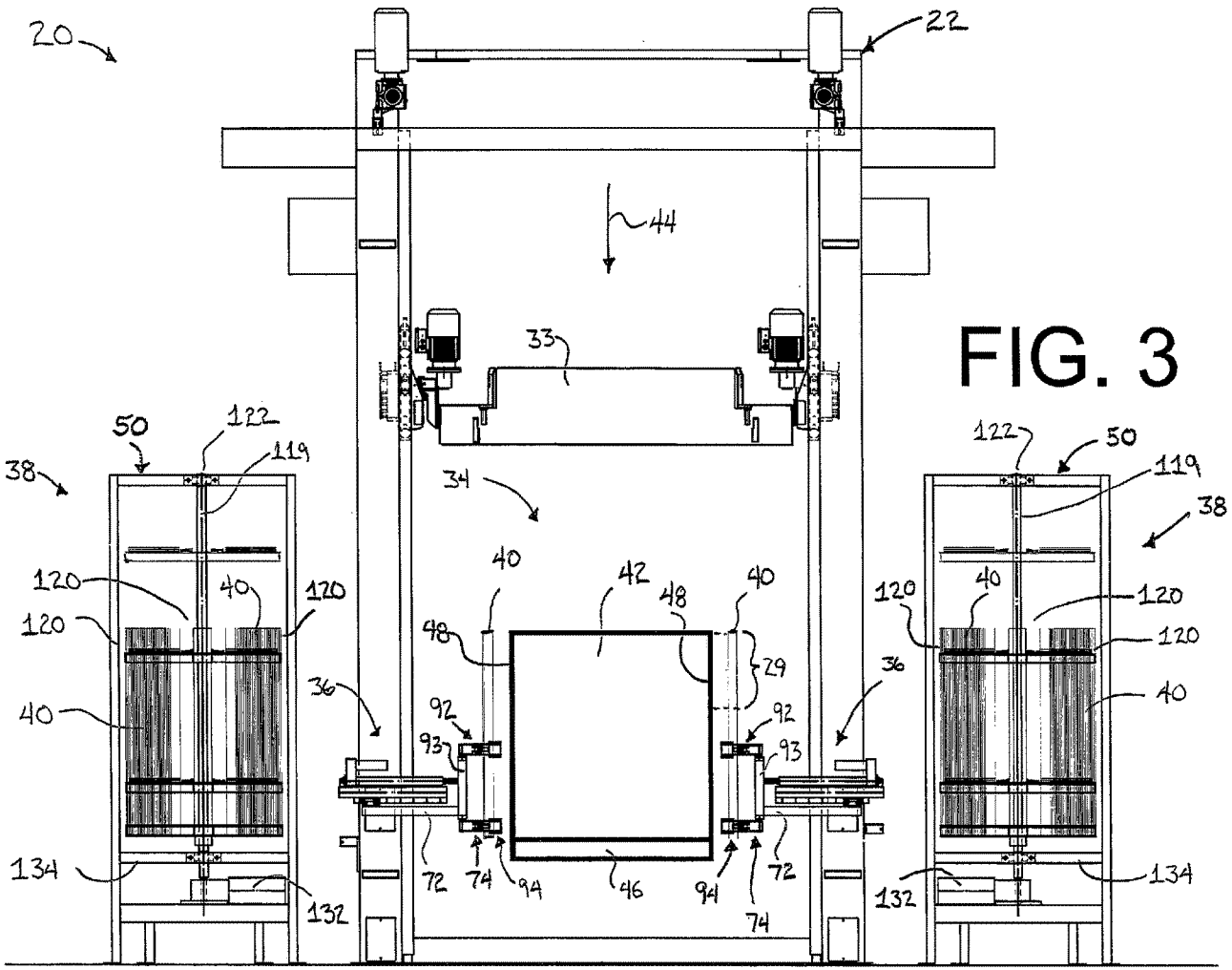
FIG. 3 is front elevation view of the system of FIG. 1.

Stretch hooding machine 22 may be a conventional stretch hooding machine, or a modified stretch hooding machine. In brief, a stretch hooding machine is adapted to pull a hood of flexible plastic material 21 down over a load 42 from top to bottom. That is, stretch hooder 22 pulls a hood down over load 42 in a downward direction 44, such as is shown in FIG. 2, via stretch hooder carriage 33. After the hood has been pulled down over the load 42, the tension on the hood is released, thereby causing the hood material—which may be any type of conventional plastic hooding material—to revert to its untensioned or less tensioned shape, which squeezes the load and binds the individual units of the load together. An example of a conventional stretch hooding machine 22 is the model HSA supplied by Möllers North America, Inc. of Grand Rapids, Michigan. The type of units that may be positioned on the load 42 is not limited by the present invention. As illustrative examples, the unit loads may be individual boxes of retail items, such as diapers, laundry soap, etc, or it may be bagged items, food, or a wide variety of other items.

Corner post application system 20 further includes a conveyor subsystem 24 that is adapted to move the load 42 to and from stretch hooding machine 22. Typically the load is made up of individual units that are stacked on top of a conventional pallet 46 (FIG. 2). Pallet 46 rides on rollers 26 of conveyor subsystem 24, which are powered and drive the load in the direction of arrow 28 (FIG. 1). Conveyor subsystem 24 includes an input section 30 and an output section 32. Input section 30 is where load 42 is moved toward enveloping machine 22 prior to load 42 being enveloped. Output section 32 is where load 42 is moved away from enveloping machine 22 after load 42 has been enveloped. Input section 30 thus delivers the load to enveloping machine 22 while output section 32 transports it away.

Stretch hooding machine 22 includes a hooding location 34 located generally in its middle where the stretch hooding material is applied to the load. Stretch hooder 22 may include a conveyor belt or system 25, or other known means, for moving the load to hooding location 34 after accepting the load from input section 30 of conveyor subsystem 24. The same conveyor belt or system 25, or other means, may then deliver the load to output section 32 after the stretch hooding operation has been completed.

Figure 4:
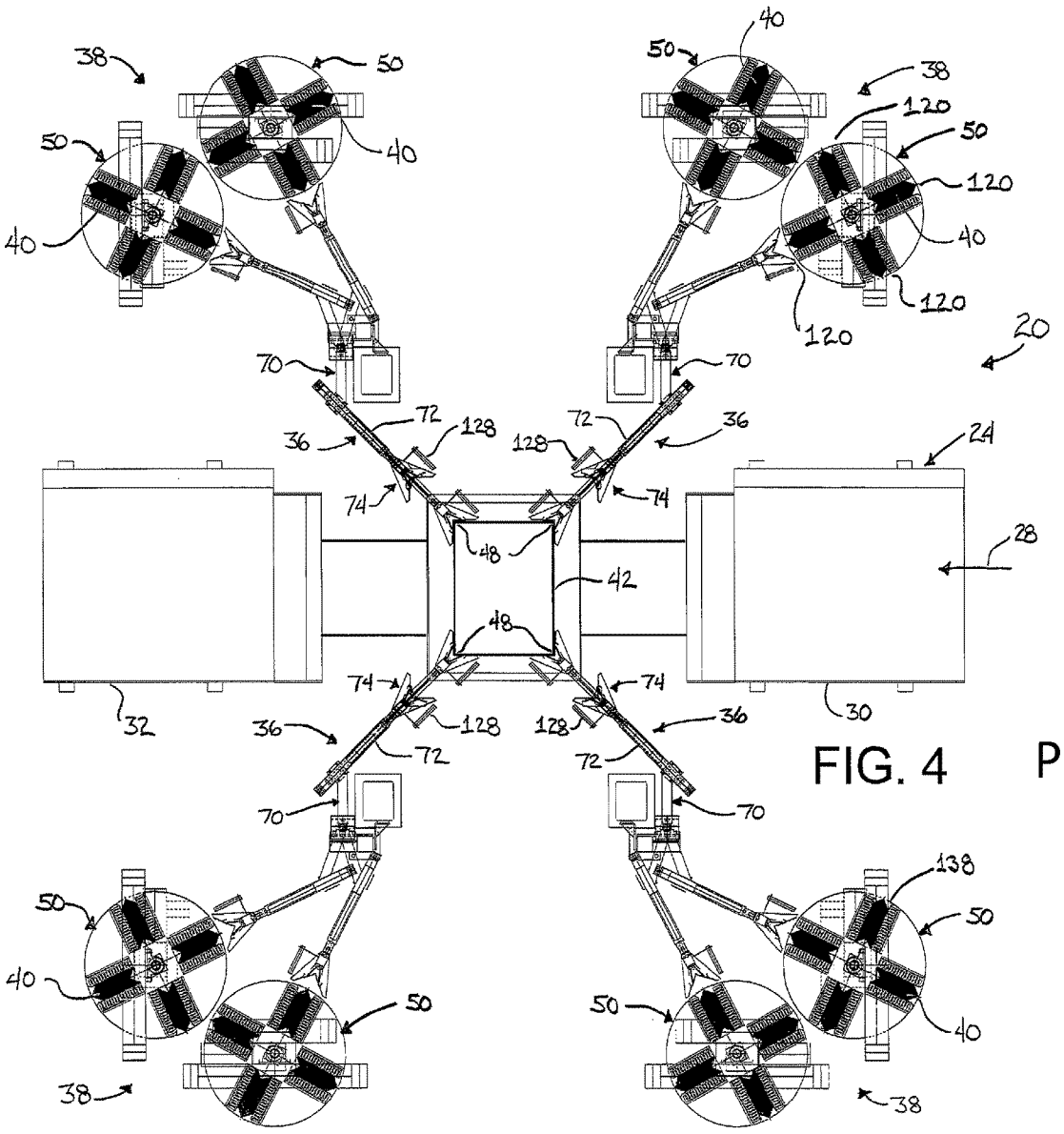
FIG. 4 PRIOR ART
FIG. 4 is a plan view of the prior art corner post application system of FIG. 1 that includes less detail regarding the stretch hooding machine and conveyor subsystem.
Figure 5:
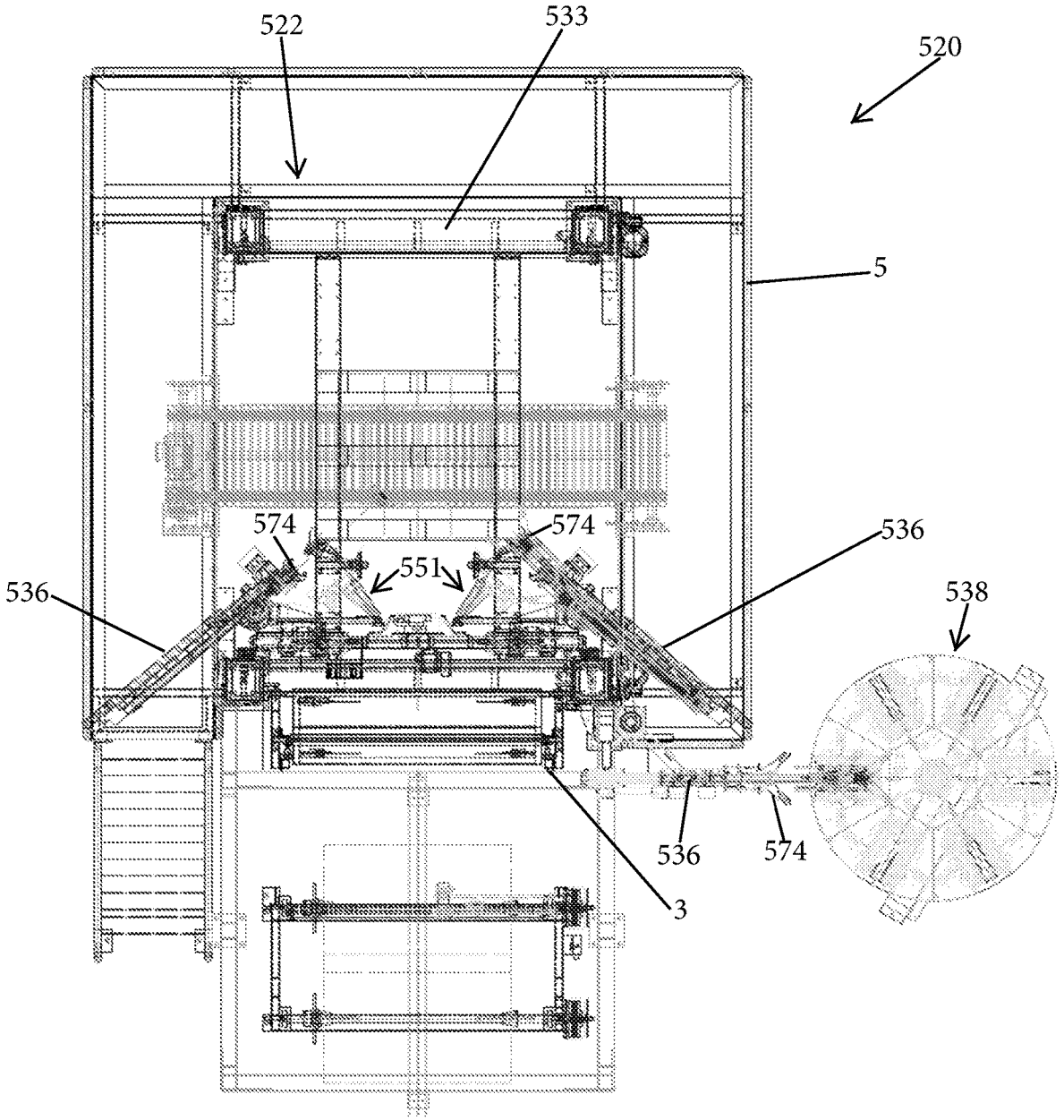
FIG. 5 is a top plan view disclosing an embodiment of an improved corner post application system in accordance with the present invention that includes a stretch hooding machine.
Figure 6:
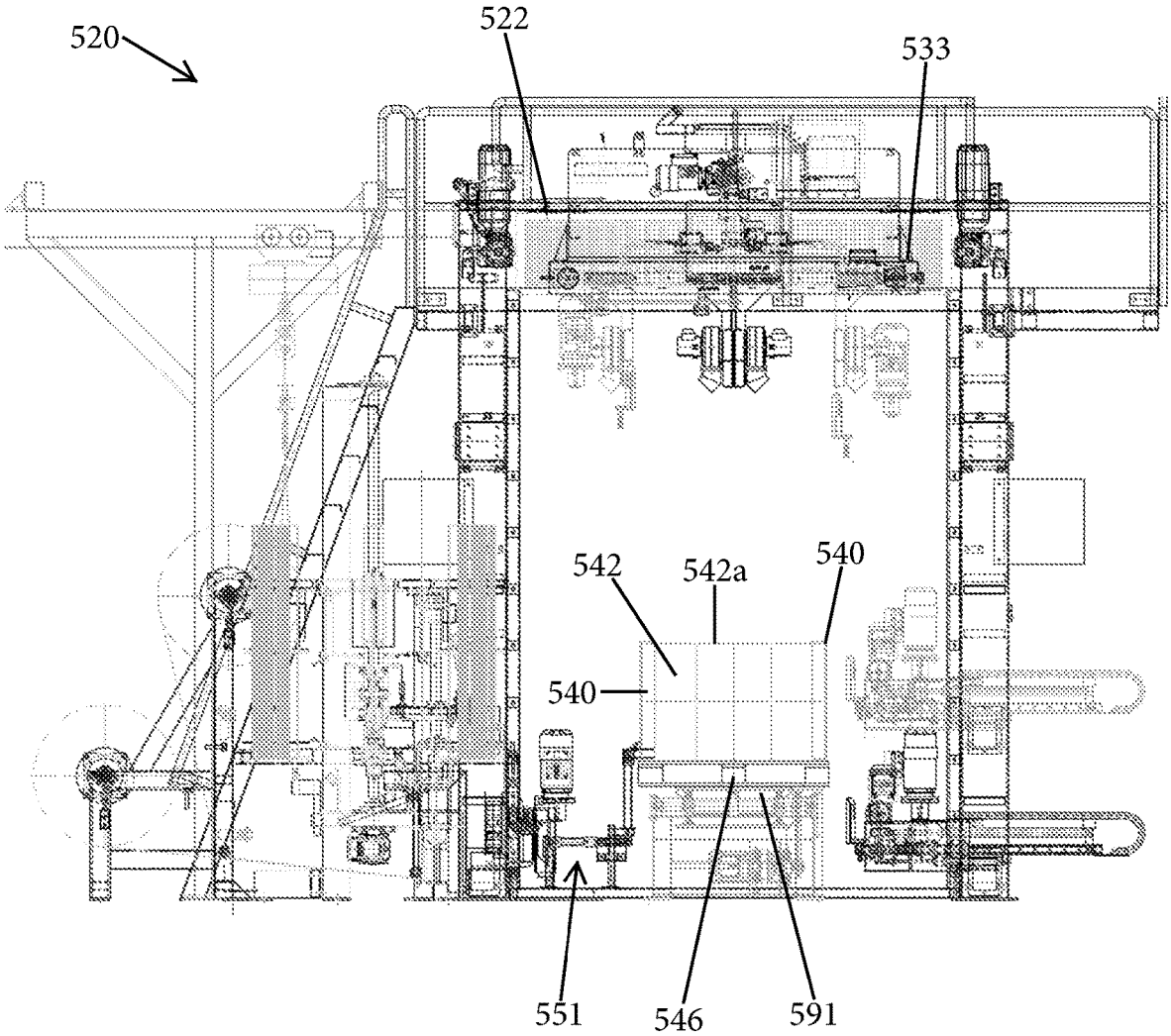
FIG. 6 is a side elevation view of the system of FIG. 5.
Figure 7:
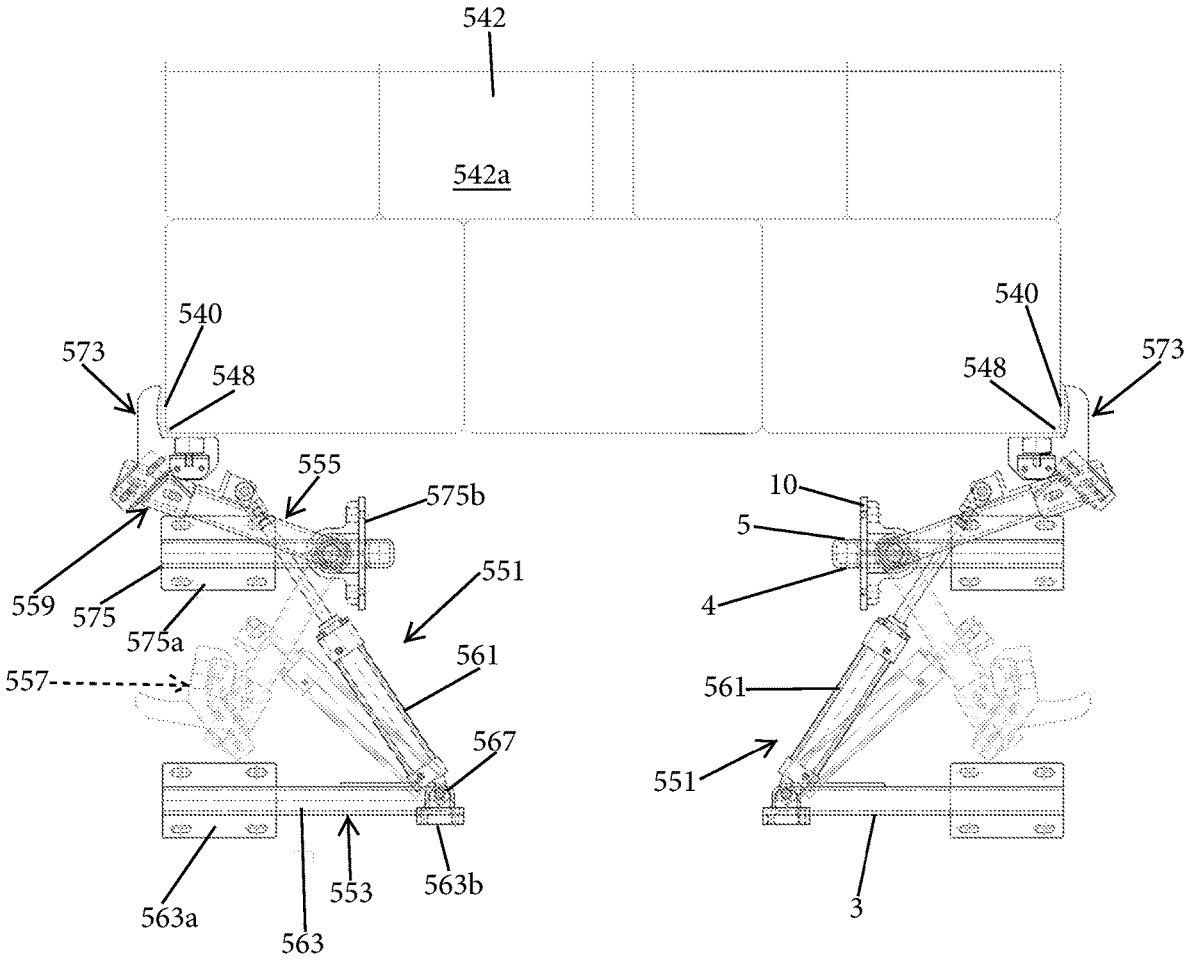
FIG. 7 is a partial top plan view of a portion of the corner post application system of FIG. 5 disclosing corner post holders in both an extended position and a retracted position relative to a load in accordance with the present invention.

Corner post application system 20 further includes at least one corner post applicator 36 and at least one corner post supply 38. In many embodiments, such as that shown in FIGS. 1-4, four corner post applicators 36 may be included within system 20 wherein each corner post applicator 36 positions a corner post 40 at one of the four vertical edges—i.e. the corners 48—of the load. While a typical load will have four such corners 48, the principles disclosed herein would be fully applicable to loads that are shaped to have more than four, or less than four, corners. It should be appreciated that in the illustrated embodiment a single corner post applicator 36 is employed for each corner, with FIGS. 1 and 4 illustrating the rotational movement of the corner post applicators 36 by way of the alternatively positioned corner post applicators 36.

Corner post supply 38 provides one or more stacks of corner posts 40 that are individually grabbed by one of the corner post applicators 36 and then moved into contact with a respective corner 48 of the load. In the embodiments shown in FIGS. 1-4, corner post supply 38 includes a pair of carousel holders 50 associated with each corner post applicator 36. It will be understood that the number of carousel holders 50 associated with each corner post applicator 36 can be varied to include only a single carousel holder 50, or two or more carousel holders 50. It will further be understood other types of corner post holders may be utilized other than the carousel holders 50 shown in FIGS. 1-4.

The shape and construction of the corner posts 40 may vary. One example of the shape of corner posts 40 is generally V-shaped when viewed from either of their ends. This V-shape defines two sides that are joined at an edge. Each side includes an inside surface and an outside surface. Inner surfaces are the surfaces that will contact the corners 48 of load 42 when the corner posts are coupled thereto. Outer surfaces will face away from the load 42 when the corner posts are coupled thereto. The angle between each side may be approximately 90 degrees such that it generally matches the angle defined by the corners 48 of the load. However, in some embodiments, sides of corner posts may be joined together at non-right angles. In other embodiments, corner posts may be curved and not include discrete sides. Other shapes are also possible.

In the various embodiments of system 20 described herein, corner posts 40 may have different heights or lengths to match loads 42 of different heights. Corner post applicator 36 is controlled to automatically select a corner post 40 of the appropriate length from corner post supply 38 that matches the height of the load currently about to undergo the stretch hooding process. The height of the load 42 about to undergo stretch hooding may be determined in known manners from a height scanning system associated with stretch hooding machine 22. The height scanning system may be located at a palletizer that determines the height when the load is placed on a pallet 46, with the height being transmitted via an Ethernet or other communication connection. Alternatively and/or additionally a height sensor 27 of such a system, such as an ultrasonic height sensor, may be mounted to stretch hooding machine 22 for measuring the height of load 42 as it enters into hooding location 34. This height is communicated to a controller 60 (FIG. 2) that controls the operation of each corner post applicator 36, as well as the corner post supply 38. If necessary, controller 60 will automatically rotate one or more of the carousel holders 50 such that a stack of corner posts 40 of the matching height face toward the associated corner post applicator 36. This will enable the corner post applicator 36 to pick a corner post from the holder 50 of a height that matches the height of the load about to be stretch hooded. This automated selection of corner posts of the correct height enables corner post applications system 20 to process successive loads of different height without requiring any human intervention to ensure that the proper corner posts are applied to the load.

As discussed in more detail in U.S. Pat. Nos. 8,938,934 and 9,802,723, each corner post applicator 36 includes a swing arm, an applicator arm, and a corner post gripper. The swing arm is rotatably coupled to a vertical rotation pivot shaft that defines a vertical axis about which swing arm may rotate. The rotation of the swing arm about the pivot shaft is automated by an actuator that operates under the control of controller.

Turning now to FIGS. 5-12, an improved corner post application system 520 in accordance with the present invention that includes corner post or board holders or holder assemblies 551 that cooperatively operate with corner post applicators 536 that may be constructed as corner board applicators 36 or 236 of U.S. Pat. Nos. 8,938,934 and 9,802,723, and the enveloping machine 522 to retain corner posts or boards in place while a load is being enveloped, and in particular are configured to retain corner boards that are shorter in length in place, such as may be used on loads that are of limited or shorter height, such that applicators 536 may be withdrawn to allow the enveloping of the load while the corner board holders 551 temporarily retain the corner boards against the load.

Figure 8:
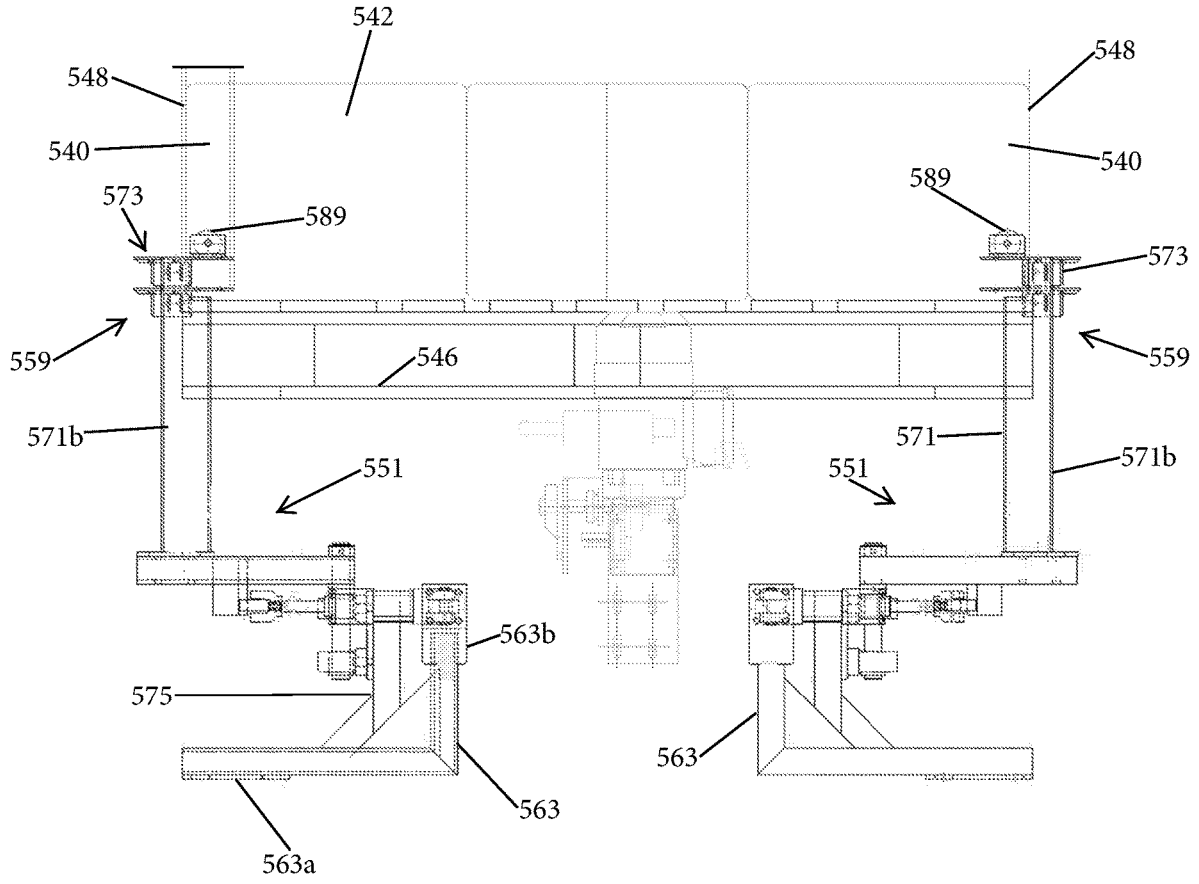
FIG. 8 is a side elevation view of the detail of FIG. 7.
Figure 9:
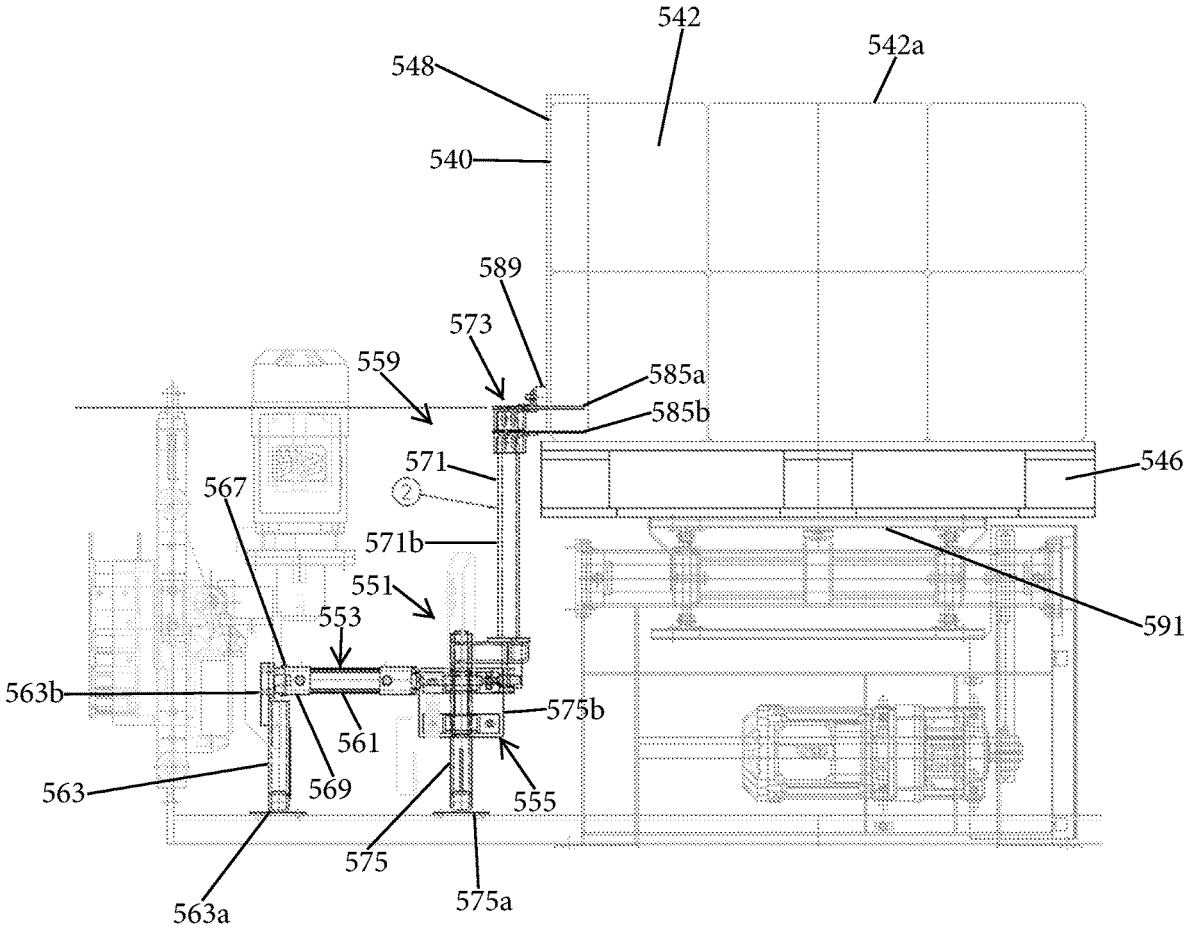
FIG. 9 is a rotated side elevation view of the detail of FIG. 7.

Similar components or features of corner post application system 520 are identified with similar reference numbers relative to the corner post application systems 20 and 220, but with "500" added to the reference numbers of corner post application system 20 and "300" added to the reference numbers of corner post application system 220. It should be appreciated, however, that corner post holders 551 discussed herein are System 520 is shown in the illustrated embodiment of FIGS. 5-9 to include two corner board holders 551 so as to be adjacent respective corners 548 of load 542 to retain corner posts or boards 540 disposed there against. It should be appreciated, however, that in practice four such corner board holders 551 may be employed that are disposed at each of the corners 548 of a load 542. As understood from FIGS. 6, 8 and 9, corner board holders 551 are configured to press against a vertically lower portion or end 540*a* of corner boards 540 to temporarily retain the corner boards 540 against the load 542 to allow the enveloping machine 522 to envelop the load 542. As discussed in more detail below, corner board applicators 536 are initially used to select corner boards 540 via grippers 574, such as from a corner post supply container 538, such as a carousel holer, and move the corner boards 540 so as to be pressed up against the corners 548 of load 542, where applicators 536 are configured to grasp the corner boards 540 at a middle portion 540*b* of the corner boards 540. Corner board holders 551 are initially in a retracted position to enable the corner boards 540 to be positioned against the load 542. Upon the corner boards 540 being placed into position by the applicators 536, the corner board holders 551 are moved into an extended position, such as shown in FIGS. 8 and 9, whereby corner board holders 551 press the corner boards 540 against corners 548 of load 542 so as to independently hold corner boards 540 in place against load 542. Upon corner board holders 551 being deployed into the extended position, the corner board applicators 536 may be retracted such that the corner boards 540 are held in place only by the corner board holders 551. Once the corner board applicators 536 are retracted, but while the corner board holders 551 are still in the extended position, the enveloping machine 522, which in the illustrated embodiment is a stretch hooder, may then be used to envelope the load 542, such as with a plastic film. This is accomplished by lowering the stretch hooding carriage 533 over the load 542. Upon stretch hooding carriage 533 applying the plastic film at the top 542*a* of load 542 and correspondingly over or on to the upper portions 540*c* of corner boards 540, the plastic film is able to retain the corner boards 540 in place whereby the corner board holders 551 may be retracted. For example, prior to retracting the corner board holders 551, the stretch hooding carriage 533 may apply the plastic film to all or a portion of the vertical extent of the top layer of individual units stacked on the pallet 546, or the stretch hooding carriage 533 may apply the plastic film to less than the entire vertical extent of the goods stacked on pallet 546. Upon retraction of the corner board holders 551, the stretch hooding carriage 533 may then be further lowered so as to envelope the remainder of the load 542, including for example onto a portion of the pallet 546.

Of note, a shorter corner board 540 is required because load 542 has a shorter vertical height due to the limited stacking of goods on pallet 546, which in the illustrated embodiment is configured as two layers of individual units stacked on pallet 546. In turn, due to the corresponding limited vertical distance between the top 542*a* of the load 542 and the pallet 546, there is not enough space available for stretch hooding carriage 533 to be lowered over the top 542*a* of load 542 and upper portions of corner boards 540 while corner board applicators 536 hold the corner board 540 in place. Accordingly, corner board holders 551 are used to retain the corner boards 540 in place with the corner board applicators 536 retracted such that the stretch hooding carriage 533 is able to apply the film over the load 542.

Figure 10:
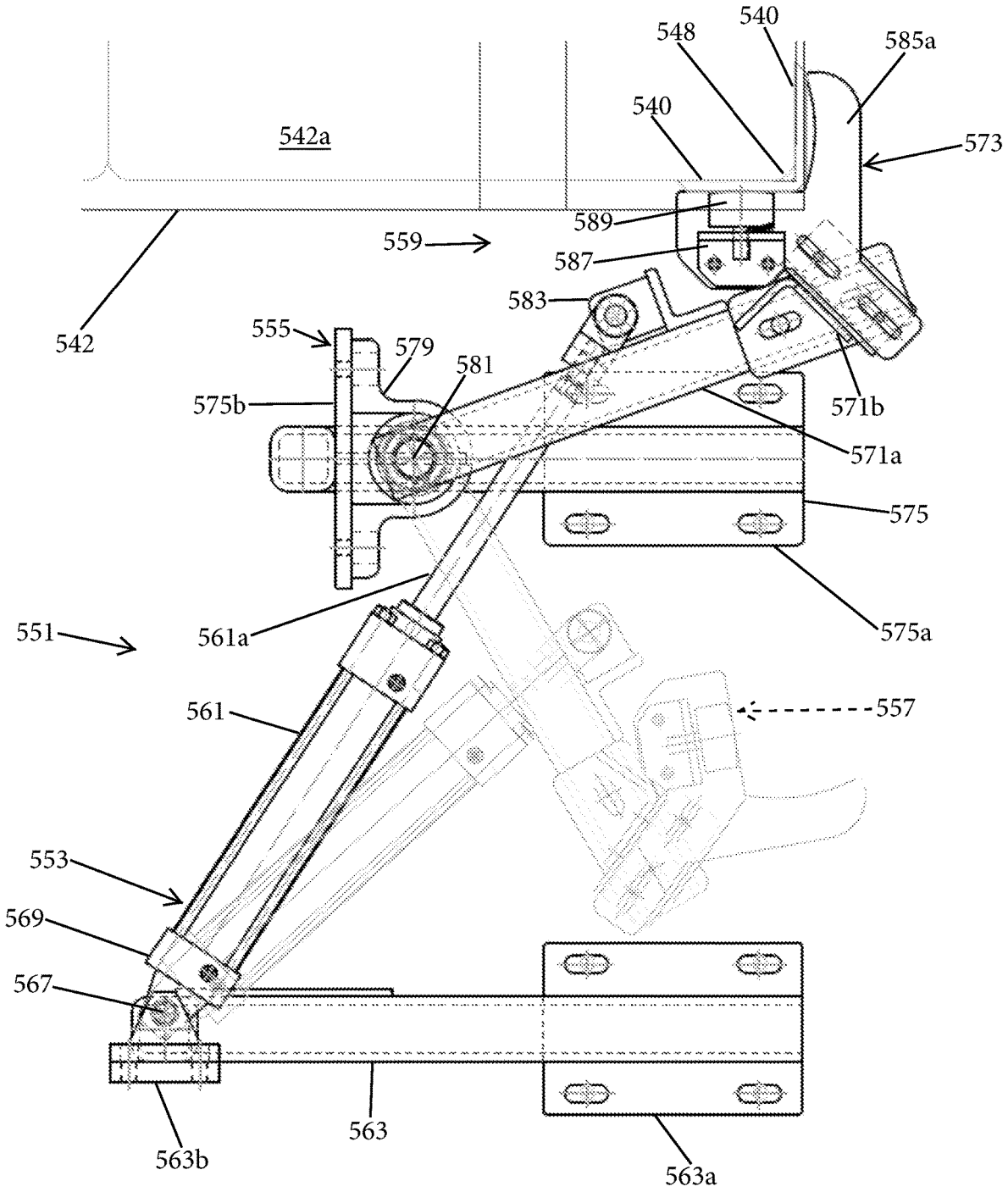
FIG. 10 is a partial close-up top plan view of a corner post holder shown in FIG. 7 shown in both an extended position and a retracted position.
Figure 11:
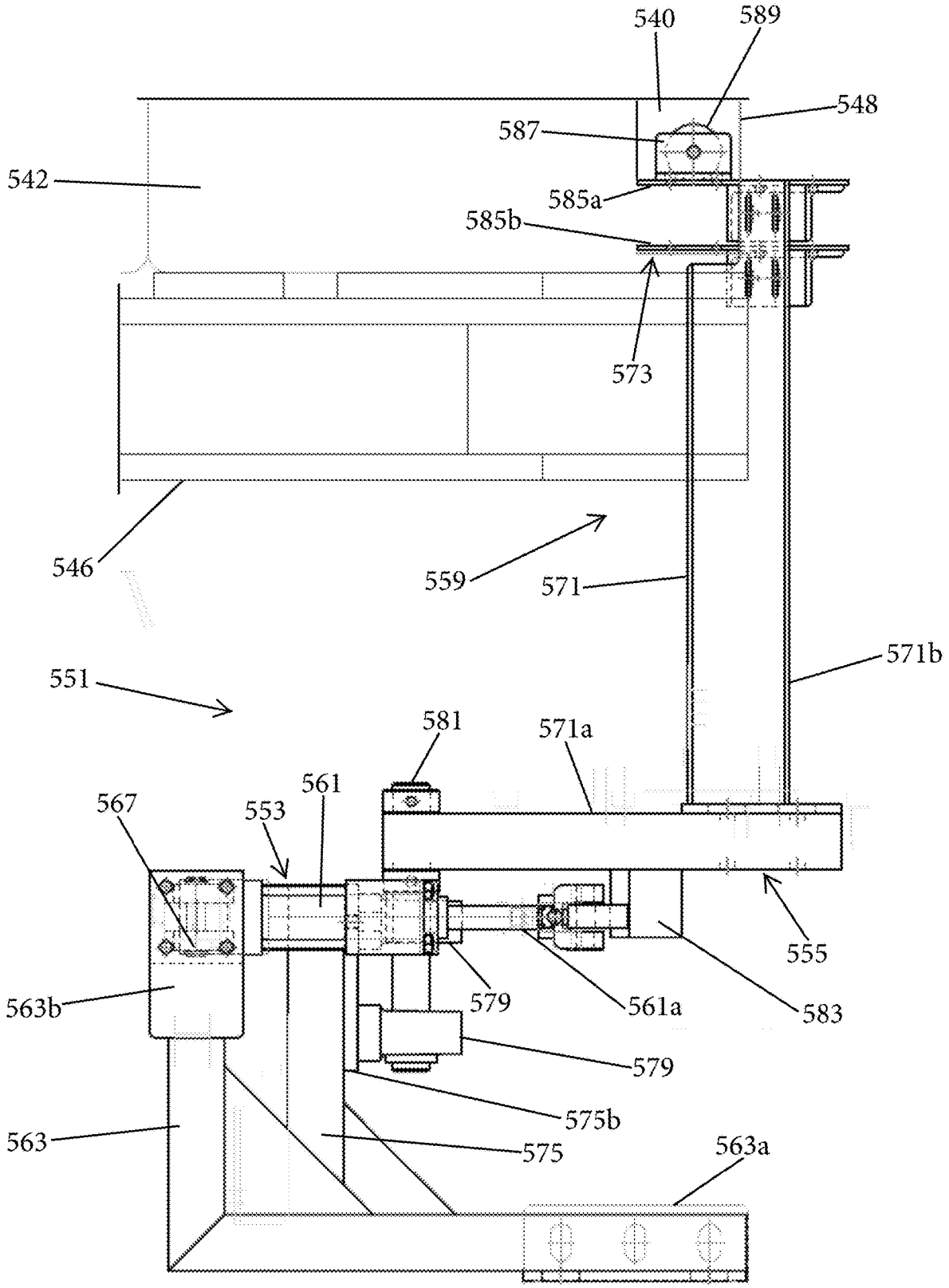
FIG. 11 is a partial side elevation view of the corner post holder shown in FIG. 10.
Figure 12:
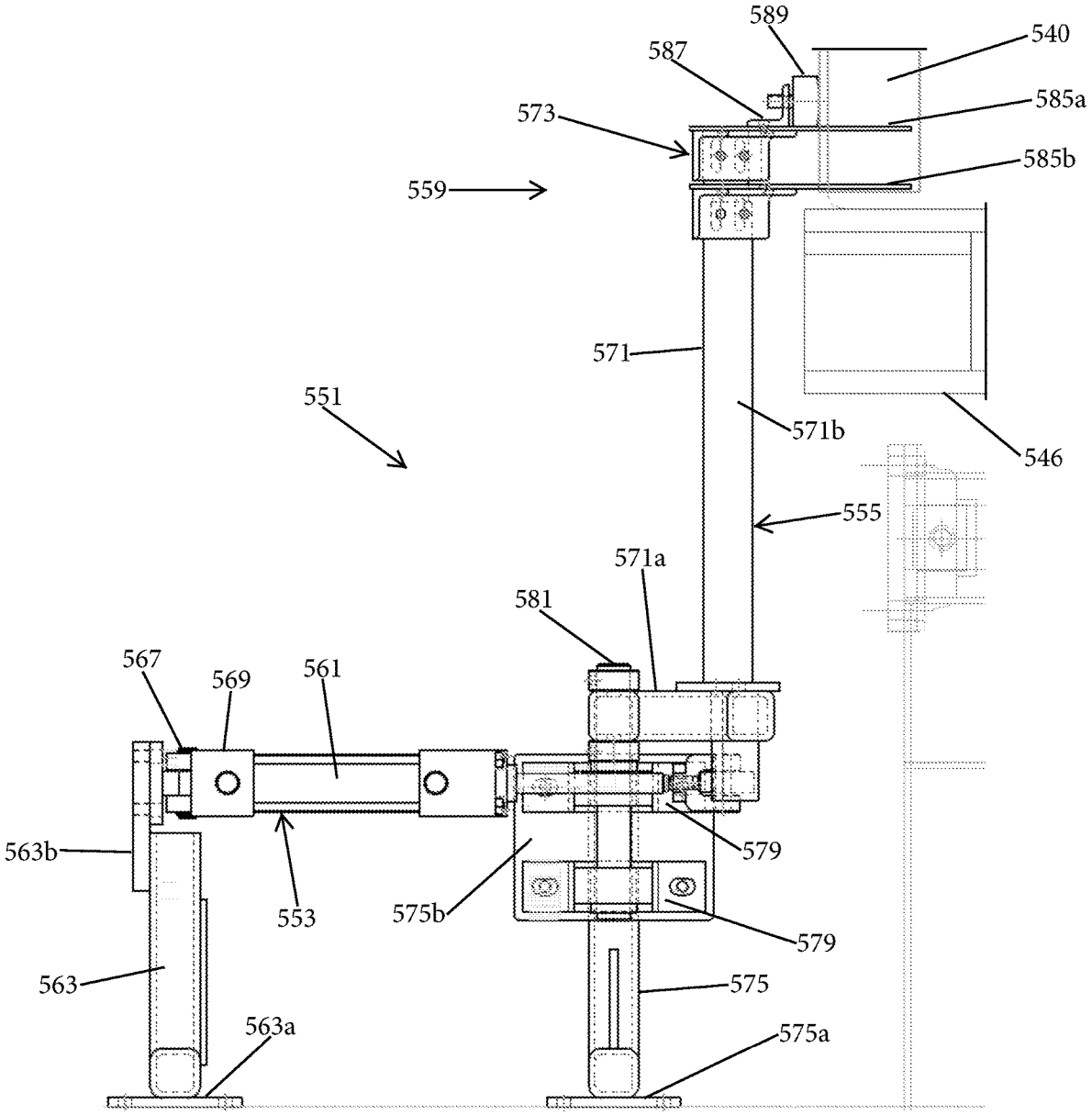
FIG. 12 is a rotated side elevation view of the corner post holder shown in FIG. 11.

With particular reference to FIGS. 10-12, in the illustrated embodiment each corner board holder assembly 551 includes a drive unit 553 coupled to a movable corner board retainer assembly 555, where the drive unit 553 is configured to move or pivot the retainer assembly 555 between, as particularly illustrated in FIG. 10, a retracted position 557 pulled away from the load 542 and an engaged or extended position 559 in which the retainer assembly 555 presses a corner board 540 against the load 542.

Drive unit 553 includes a driver, which in the illustrated embodiment is configured as a cylinder 561 having an extendable and retractable cylinder arm 561*a*, and includes a drive mount or cylinder mount 563. Cylinder mount 563 is configured as an L-shaped leg having a horizontal portion for positioning on a support surface, such as by way of a mounting plate 563*a*, and has a vertically extending portion to which cylinder 561 is attached by mounting plate 563*b*. Mounting plate 563*b* in turn provides a pivot connector or axle 567 for cylinder 561 to enable the base 569 of cylinder 561 to pivot.

Retainer assembly 555 in turn includes a clamp arm 571 to which is attached a clamp 573 that may be configured as a holder or retainer or jaw, with clamp arm 571 being configured as a pivot arm that is movably supported by a clamp mount 575. Clamp mount 575 is configured as an L-shaped leg having a horizontal portion for positioning on a support surface, such as by way of a mounting plate 575*a*, and has a vertically extending portion to which pivot arm 571 is attached by mounting plate 575*b*. Mounting plate 575*b* supports a pair of bearings 579 that rotatably hold a pivot shaft or pin 581, with clamp arm 571 being attached to pivot arm 581.

In the illustrated embodiment pivot arm 571 includes a side arm portion 571*a* and an upwardly extending portion 571*b*, where in the illustrated embodiment side arm portion 571*a* extends horizontally and upward portion 571*b* is vertically oriented. Horizontal portion 571*a* is mounted at one end to pivot shaft 581, with upright portion 571*b* being affixed to the opposite end of horizontal portion 571*a*. In turn, the opposite end of upward portion 571*b* supports clamp 573. Horizontal portion 571*a* includes a bracket 583 to which cylinder arm 561*a* is connected. Accordingly, extension of arm 561*a* positions or moves pivot arm 571 into the extended or engaged position 559, and retraction of arm 561 correspondingly positions or moves pivot arm 571 into the retracted position 557.

Clamp 573 in the illustrated embodiment includes a pair of spaced apart holders 585*a*, 585*b* that each include an approximately ninety-degree opening. The upper holder 585*a* includes a bracket 587 to which a bumper 589 is secured. When pivot arm 571 is in the engaged position 559, bumper 589 presses against the corner board 540.

It should be appreciated that corner board holders 551 may not be required for each load that is moved to enveloping machine 522. Accordingly, the operational method of corner board application system 520 may include determining when use of corner board holders 551 is required, such as based on the height of a given load, along with other parameters such as the unit material/packaging used on the load. A controller, such as controller 60 disclosed above, may be used to control the operation of corner board application system 520, including corner board holders 551. The controller is configured to implement use of the corner board holders 551 upon detection and/or determination that a load 542 is of a particular vertical height so as to require corner boards 540 that are shorter in length such that stretch hooding carriage 533 would not be able to apply a film over the load 542 while corner board applicators 536 hold such a corner board 540 in place against the corners 548 of the load 542. This detection and/or determination may be accomplished by a load height sensor, for example, or may be an attribute attributed to the load, such as a programed variable based on the type of load unis and/or amount placed loaded onto a pallet 546.

With the load 542 disposed at the enveloping machine 522, the controller may cause applicators 536 to select the appropriate corner board 540 from the corner board supply container 538 for the given load 542. The applicators 536 will initially place the corner boards 540 against the corners 548 of the load 542 with the corner board holders 551 in the retracted position 557. Cylinders 561 will then be caused to extend cylinder arms 561*a* whereby the pivot arms 571 will be rotated into the engaged position 559 with clamps 573 thus pressed against the lower potion 540*a* of corner boards 540. After which, applicators 536 are retracted such that the corner boards 540 are being held in place just by the corner board holders 551. The stretch hooding carriage 533 is then lowered to apply a film over the top 542*a* of the load 542 and correspondingly over the top portion 540*c* of the corner boards 540. Upon the corner boards 540 being held sufficiently in place by the film, cylinders will be caused to retract cylinder arms 561*a* whereby the pivot arms 571 will be rotated into the retracted position 557, whereby the stretch hooding carriage 533 may continue traveling to place the film about the remainder of the load 542 and down to or on the pallet 546.

As shown, pallet 546 is held on a support 591, such as a powered conveyor or turntable section, while the stretch hooding plastic film is applied thereabout, with corner board holders 551 being disposed about and below the support 591 on which pallet 546 is placed. Moreover, pivot arm 571 is configured to extend upwardly from below support 591 to engage with corner boards 540 on load 542. It should be appreciated that the stretch hooding carriage 533 may itself include various arms for holding, stretching and applying the covering film over load 542, and include various motors for movement of the carriage including the carriage arms. Accordingly, corner board holders 551 are configured so as to be sufficiently out of the way of stretch hooding carriage 533 when moved into the retracted position 557 to thereby not interfere with the movement of stretch hooding carriage 533.

It should be appreciated that alternatively configured and operating corner board holders may be employed within the scope of the present invention other than corner board holders 551 disclosed above. For example, the retainer assemblies may be configured for movement other than pivoting movement, such as linear movement, including being driven by alternative drives or drive units, such as linear actuators. Still further, corner board holders may grasp or hold corner boards in alternative manners and locations as compared to that disclosed above. Thus, changes and modifications in the specifically described embodiments can be carried out without departing from the principles of the present invention which is intended to be limited only by the scope of the appended claims, as interpreted according to the principles of patent law including the doctrine of equivalents.

What is claimed is:

1. A corner post application system for a load containing a plurality of units defining corners of the load, said corner post application system comprising:

a plurality of corner post applicators each having a corner post gripper configured to grasp a corner post, wherein each said corner post applicator is configured to move a respective corner post to a load and engage the corner post with a respective corner of the load; and a plurality of moveable corner post holders each having a clamp, wherein said corner post holders are configured to move between a retracted position and an engaged position, and wherein in said engaged position said clamp is configured to engage a respective one of the corner posts to press the corner post against the load at the respective corner;

wherein when said corner post holders are in said engaged position said corner post applicators are configured to be retracted with the corner posts being held in engagement with the corners of the load by said corner post holders to enable an enveloping machine to initiate placement of a film over the load, and wherein each said corner post holder comprises a drive unit and a clamp arm with said clamp mounted to said clamp arm, and wherein said drive unit is operable to move said corner post holder between said retracted position and said engaged position.

2. The system of claim 1, wherein said clamp arm comprises a pivot arm configured to pivot about a pivot axis between said retracted position and said engaged position.

3. The system of claim 2, wherein said pivot axis about which said pivot arm is configured to pivot comprises a vertical axis.

4. The system of claim 2, wherein said pivot arm comprises an upwardly extending portion with said clamp mounted to an upper end of said upwardly extending portion of said pivot arm, and wherein said drive unit is positioned vertically lower than said clamp.

5. The system of claim 1, wherein said drive unit comprises a cylinder.

6. The system of claim 1, wherein said corner post applicators are configured to grasp corner posts at a first position along an elongate length of the corner posts and said clamps are configured to engage the corner posts at a second position along the elongate length of the corner posts.

7. The system of claim 6, wherein said clamps are configured to engage the corner posts at a vertically lower position than where said corner post applicators are configured to grasp the corner posts.

8. A corner post application system for a load containing a plurality of units defining corners of the load, said corner post application system comprising:

a load support;

an enveloping machine adapted to envelope the load with a film when the load is disposed on said load support;

a plurality of corner post containers for storage of corner posts;

a plurality of corner post applicators configured to grasp a corner post from a selected one of said corner post containers, wherein each said corner post applicator is configured to move a respective corner post to a load and engage the corner post with a respective corner of the load; and a plurality of moveable corner post holders each having a clamp, wherein said corner post holders are configured to move between a retracted position and an engaged position, and wherein in said engaged position said clamp is configured to engage a respective one of the corner posts to press the corner post against the load at the respective corner;

wherein when said corner post holders are in said engaged position said corner post applicators are configured to be retracted with the corner posts being held in engagement with the corners of the load by said corner post holders to enable said enveloping machine to initiate placement of a film over the load, and wherein each said corner post holder comprises a drive unit and a clamp arm with said clamp mounted to said clamp arm, and wherein said drive unit is operable to move said corner post holder between said retracted position and said engaged position.

9. The system of claim 8, wherein said enveloping machine is a stretch hooding machine and includes a stretch hooding carriage, and wherein said stretch hooding carriage is configured to apply the film to the load starting from the top of the load, and wherein said corner post applicators are configured to be retracted with the corner posts being held in engagement with the corners of the load by said corner post holders when said stretch hooding carriage applies the film to the top of the load and top portions of the corner posts.

10. The system of claim 8, wherein said clamp arm comprises a pivot arm configured to pivot about a pivot axis between said retracted position and said engaged position.

11. The system of claim 10, wherein said pivot axis about which said pivot arm is configured to pivot comprises a vertical axis, and wherein said pivot arm comprises an upwardly extending portion with said clamp mounted to an upper end of said upwardly extending portion of said pivot arm, and wherein said drive unit is positioned vertically lower than said clamp.

12. The system of claim 10, wherein said drive unit comprises a cylinder with a telescoping cylinder arm, and wherein said cylinder arm is coupled to said clamp arm.

13. The system of claim 8, wherein said clamps are configured to engage the corner posts at a vertically lower position than where said corner post applicators are configured to grasp the corner posts.

* * * * *